US006301791B1

(12) United States Patent
Lüttgens

(10) Patent No.: US 6,301,791 B1
(45) Date of Patent: Oct. 16, 2001

(54) SHARPENER FOR SOFT-CORE PENCILS

(75) Inventor: Fritz Lüttgens, Erlangen (DE)

(73) Assignee: KUM Limited, Dublin (IE)

( * ) Notice: Subject to any disclaimer, the term of this patent is extended or adjusted under 35 U.S.C. 154(b) by 0 days.

(21) Appl. No.: 09/543,888

(22) Filed: Apr. 6, 2000

(30) Foreign Application Priority Data

Apr. 6, 1999 (DE) ..... 199 15 384

(51) Int. Cl.[7] ..... B43K 23/08
(52) U.S. Cl. ..... 30/454; 30/455
(58) Field of Search ..... 30/451, 452, 454, 30/455, 457–461

(56) References Cited

U.S. PATENT DOCUMENTS 4,248,283 * 2/1981 Kaye ..... 30/454
5,845,406 12/1998 Lüttgens .

FOREIGN PATENT DOCUMENTS 1 042 427 10/1958 (DE) .
37 37 863 8/1988 (DE) .
44 40 271 5/1996 (DE) .
297 23 552 11/1998 (DE) .
0 872 356 10/1998 (EP) .

* cited by examiner

*Primary Examiner*—Douglas D. Watts
(74) *Attorney, Agent, or Firm*—Venable; Gabor J. Kelemen

(57) ABSTRACT

A sharpener for soft-core pencils includes a core shaper with a shaping edge for shaping the core tip, the edge being positioned in the free space in front of the pencil-guiding channel. This shaping edge is a part of a detachably-secured, separate insert, which limits the free space at the rear housing side, and supports the shaping edge on its side facing the guide channel.

14 Claims, 7 Drawing Sheets

FIG.2
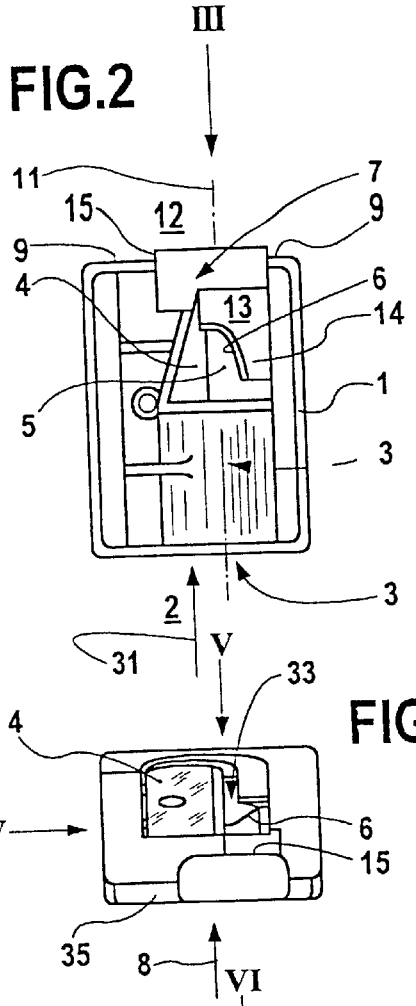
FIG.3
FIG.4
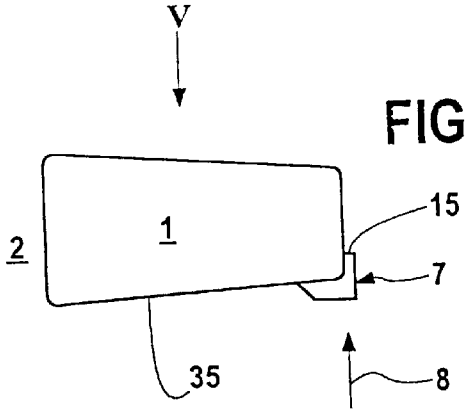
FIG.5
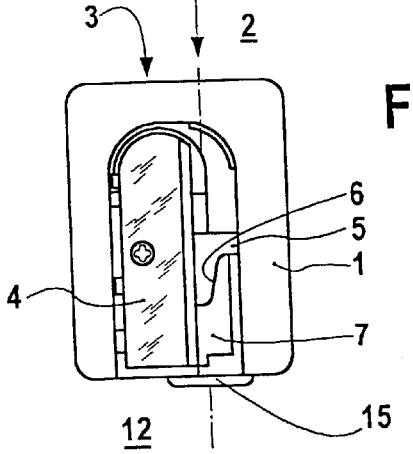
FIG.6
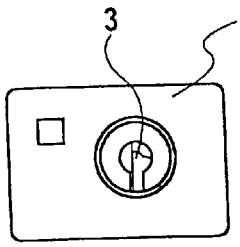

SHARPENER FOR SOFT-CORE PENCILS

CROSS REFERENCE TO RELATED APPLICATION

This application claims the right of priority of German patent application No. 199 15 384.1, filed Apr. 6, 1999, the disclosure of which is incorporated herein in its entirety by reference.

BACKGROUND OF THE INVENTION

The invention relates to a sharpener for soft-core pencils. An example of such a sharpener is disclosed in German laid-open patent application No. 44 40 271. The term "soft-core pencils" refers to pencils having a carrier material that can be peeled off, such as wood or plastic, as well as those having bare soft cores, which are conventionally used as makeup or cosmetic pencils.

In a known sharpener of the above-mentioned type, the core shaper is a shaping blade that can be adjusted on a transverse slide between a shaping position and a retracted position, transversely to the longitudinal axis of the sharpener channel. The transverse slide is positioned in the free space that receives the pencil cone during sharpening. The sharpener or guide channel provided in the housing for the pencil is located in front of the free space. Depending on the position of the transverse slide, the pencil tip can selectively be given a relatively sharp, pointed or rounded shape, while the sharpening blade assumes the task of shaping the pencil cone and, simultaneously peeling off the pencil jacket (if present) as the pencil, guided in the guide channel, is rotated for sharpening.

In a modification of such a sharpener, two shaping blades are disposed side-by-side on the transverse slide for selectively sharpening the tip to varying degrees of roundness. Because of the narrow spatial conditions in the region of the side of the free space facing away from the sharpening channel, the transverse slide is complicated to produce. Furthermore, the slide hinders the periodically necessary removal of the built-up core mass which tends to smear easily and jam the transverse slide guide in the housing in the region of the core shaper.

In a similar sharpener for soft-core pencils that is known from European published patent application 0 872 356, the core shaper is a scraping tongue that is formed onto the cleaning end of an accompanying cleaning implement. When the sharpener is in the operative state, the cleaning implement is snapped to the sharpener housing with a holder such that the free end of the scraping tongue that is integral with the implement tip projects out of the space, beyond a side wall of the free space in front thereof, and into the free space in the direction of the sharpening blade, transversely to the longitudinal axis of the guide channel. In the process, the tip of the scraping tongue extends slightly below the sharpening blade, thus assuring shaping of the entire core tip up to the longitudinal axis of the core. This solution facilitates sharpener cleaning, the primary problem being the hygienic removal of the built-up soft-core mass.

The scraping tongue projecting laterally from the cleaning implement is inconvenient during the cleaning process involving the cleaning implement if the tongue hinders the implement tip from accessing angled corners of the sharpener housing or the free space provided in the housing for receiving the pencil cone to be sharpened. Moreover, some dexterity is required for securing the cleaning implement to the sharpener housing, with the scraping tongue being repositioned in its default position slightly around the sharpening blade following the cleaning process, in order to prevent damage to the sharp scraping tongue. The cleaning implement, and thus the integral scraping tongue are of a relatively soft plastic to prevent dulling of the sharp cutting edge of the sharpening blade during the cleaning process.

SUMMARY OF THE INVENTION

It is an object of the invention to provide an improved sharpener of the above-described type to facilitate the hygienic cleaning and removal of the sticky soft-core mass, and reliably prevent damage to the core shaper caused by the cleaning process. This object and others to become apparent as the application progresses, are accomplished by the invention, according to which, briefly stated, a sharpener for sharpening an end of a pencil having a soft core includes a housing body defining a free space and a guide channel for receiving and centering the end of the pencil. The guide channel is tapered towards its front end and has a side opening. The sharpener also includes a sharpening blade disposed along the side opening for sharpening the pencil end into a conical shape and an exchangeable insert secured in the free space of the housing body in front of the front end of the guide channel. The insert has a shaping edge for shaping the pencil core that faces the guide channel and is spaced from the sharpening blade.

The core shaper is no longer an integrated, integral component of a standard, accompanying cleaning implement whose cleaning end can be so shaped as to perform solely its intended cleaning task. The invention also contributes beneficially to the trend toward a diversification of pencil shapes that in cosmetic pencils which are available in a wide variety of diameters. The soft-core diameter often varies in pencils of the same diameter. Adapting the entire sharpener to the wide array of dimensions is very complicated in terms of the manufacturing tools required, particularly if the sharpener housing is a plastic, one-piece injected part, which is predominantly the case. This problem is compounded by the increasingly complex chemical formulas used in soft pencil cores, which the sharpener must also accommodate by way of the embodiment of its core shaper. The invention also makes available a sharpener whose modular design can be adapted flexibly and inexpensively to this developmental trend, and—whenever not necessary—can be used without a core-shaping insert. In accordance with the invention, the core shaper can also be adapted simply to more stringent technical requirements, such as antibacterial plastic quality, coating and the like.

According to another aspect of the invention, the core shaper can be compact, and therefore less susceptible to damage. The user can detach and reattach it simply in accordance with a snap connection or a frictional clamping. It is easily possible to detach and re-insert the insert without the sharpening blade presenting a problem. Accordingly, detachable securing elements can be provided with fittings or retaining elements, which assure a secure position in the joined state, and require a constant, predeterminable exertion of force to be detached.

The invention can also facilitate the exertion of the detaching force on the insert without a separate detaching tool.

The invention also permits variable options for inserting a core shaper. The same core shaper can produce different shapes or degrees of roundness of the core tip.

The invention further provides that the insert can be simply positioned, and reliably maintain its position, beneath the sharpening blade in the sharpener body. Securing elements attached to the two opposite side walls hold the insert in an intermediate position against the walls.

According to the invention, the same insert may be provided with a plurality of shaping edges that can be respectively brought into the operative position through a corresponding rotation inside the housing body.

An alternative for securing the insert to the housing body takes into account the fact that the housing body, which is typically produced from injected plastic, is closed nearly all the way around and is provided with comparatively thin-walled long and short sides whose lower ends are formed as wall edges. The wall edges of all sides of the housing body lie in a common plane, and surround a body floor between themselves that is cleaved due to the functional embodiment. The body floor is therefore shielded, and not visible, in the typical resting position of the sharpener on a table surface or the like, namely with the blade facing up. This regular construction of the housing body from a plastic housing body injected in one piece is not only the norm out of design considerations, but also based on injection technology, for assuring thin walls that are extensively dimensioned identically, and for avoiding unsightly sink marks that are associated with injection technology. A push-on connection is provided as an alternative so that the housing body itself need not be provided with additional securing elements. It is also easily possible to retrofit or provide a core shaper for existing soft-core sharpeners that are not provided with a core shaper. According to a further advantage of this variant the securing region of the insert, which is pushed onto the closing wall of the housing, projects outward beyond the closing wall, offering user-friendly handling for the process of detaching the insert from the sharpener housing.

The invention may also provide a color-coding system that significantly facilitates the distinction between the contours of the core shapers formed as inserts. The sharpener can be rendered more versatile by a plurality of different core shapers provided as a kit.

BRIEF DESCRIPTION OF THE DRAWINGS

FIG. 2 is a bottom plan view, in the direction of arrow II of FIG. 1, of the underside of the sharpener housing, with an insert in place.

FIG. 3 is a rear elevational view of the sharpener in the direction of arrow III of FIG. 2.

FIG. 4 is a side elevational view in the arrow direction IV of FIG. 3.

FIG. 5 is a top plan view of the top side of the sharpener housing in the arrow direction V of FIG. 3 or 4.

FIG. 6 is a front elevational view of the pencil-insertion side of the sharpener in the arrow direction VI of FIG. 5.

DETAILED DESCRIPTION OF THE PREFERRED EMBODIMENTS

Figure 1:
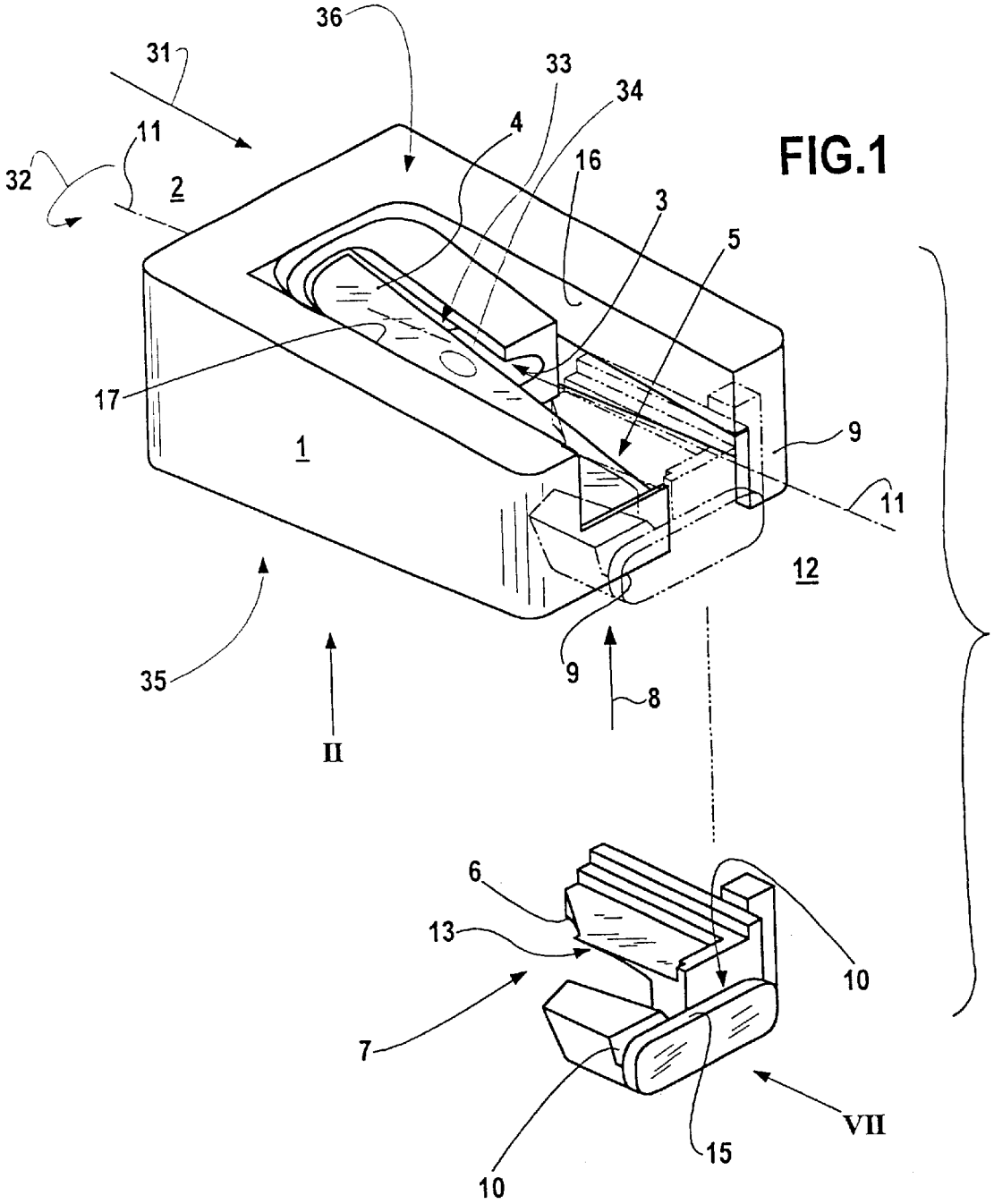
FIG. 1 is an exploded perspective view of a first embodiment of the sharpener, with an insert provided as a core shaper, the insert being shown in solid lines removed from the sharpener and with dashed lines showing the insert in place in the sharpener.
Figures 7, 8, 9:
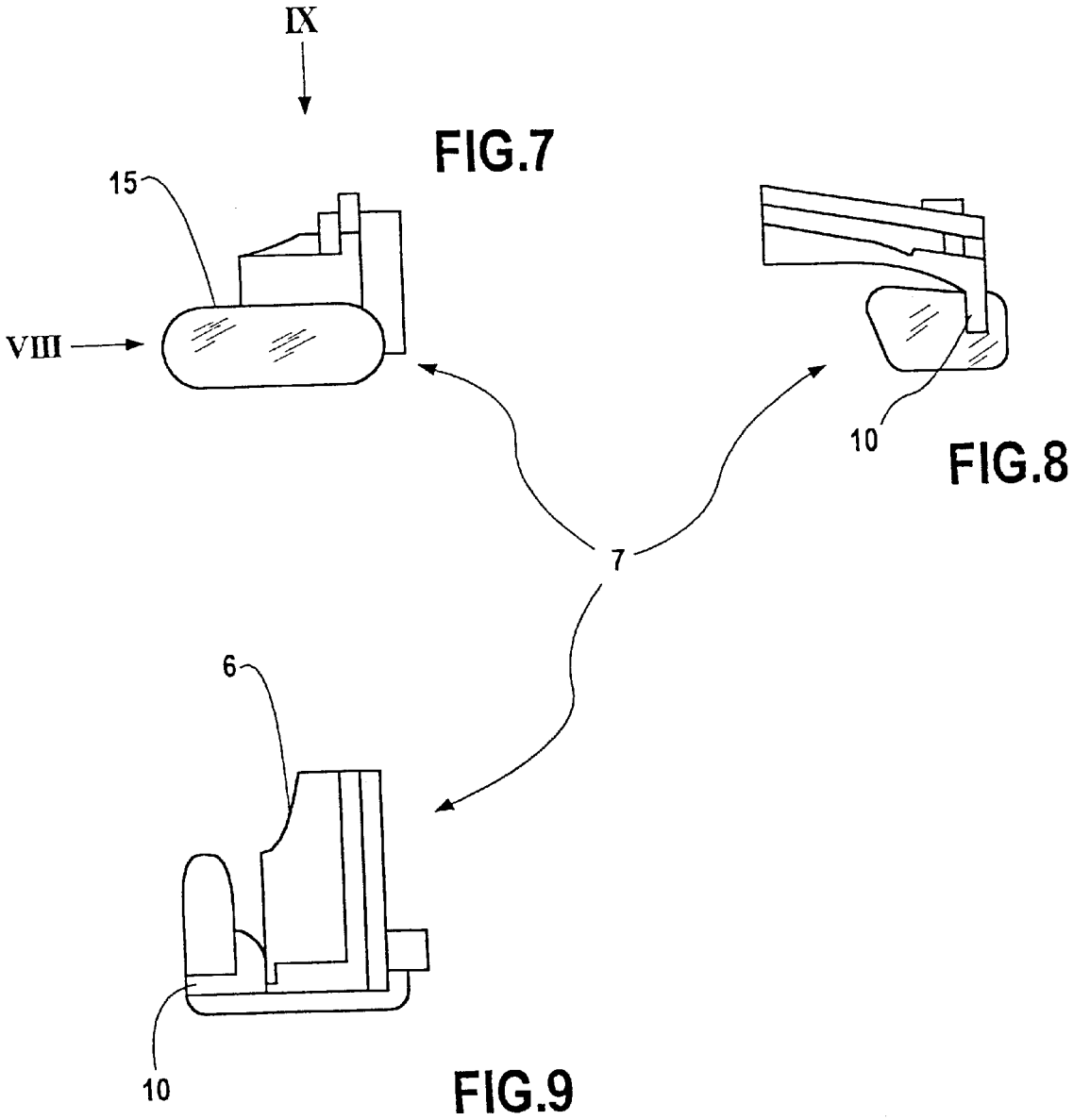
FIG. 7 is a rear elevational view of the insert acting as a core shaper, in the arrow direction VII of FIG. 1.
FIG. 8 is a front view of the insert in the direction of arrow VIII of FIG. 7.
FIG. 9 is a plan view in the direction of arrow IX of FIG. 7.

At its end facing the insertion side 2 for the soft-core pencil to be sharpened, the housing body 1 surrounds a guide channel 3, which conically tapers in the insertion direction 31 and serves as a housing-side guide for the soft-core pencil, not shown, to be sharpened into an essentially conical shape. Above the guide channel 3, the housing 1 supports a sharpening blade 4, which is secured with a screw. This blade flanks the guide channel 3 in the region of a side opening 33.

Figure 10:
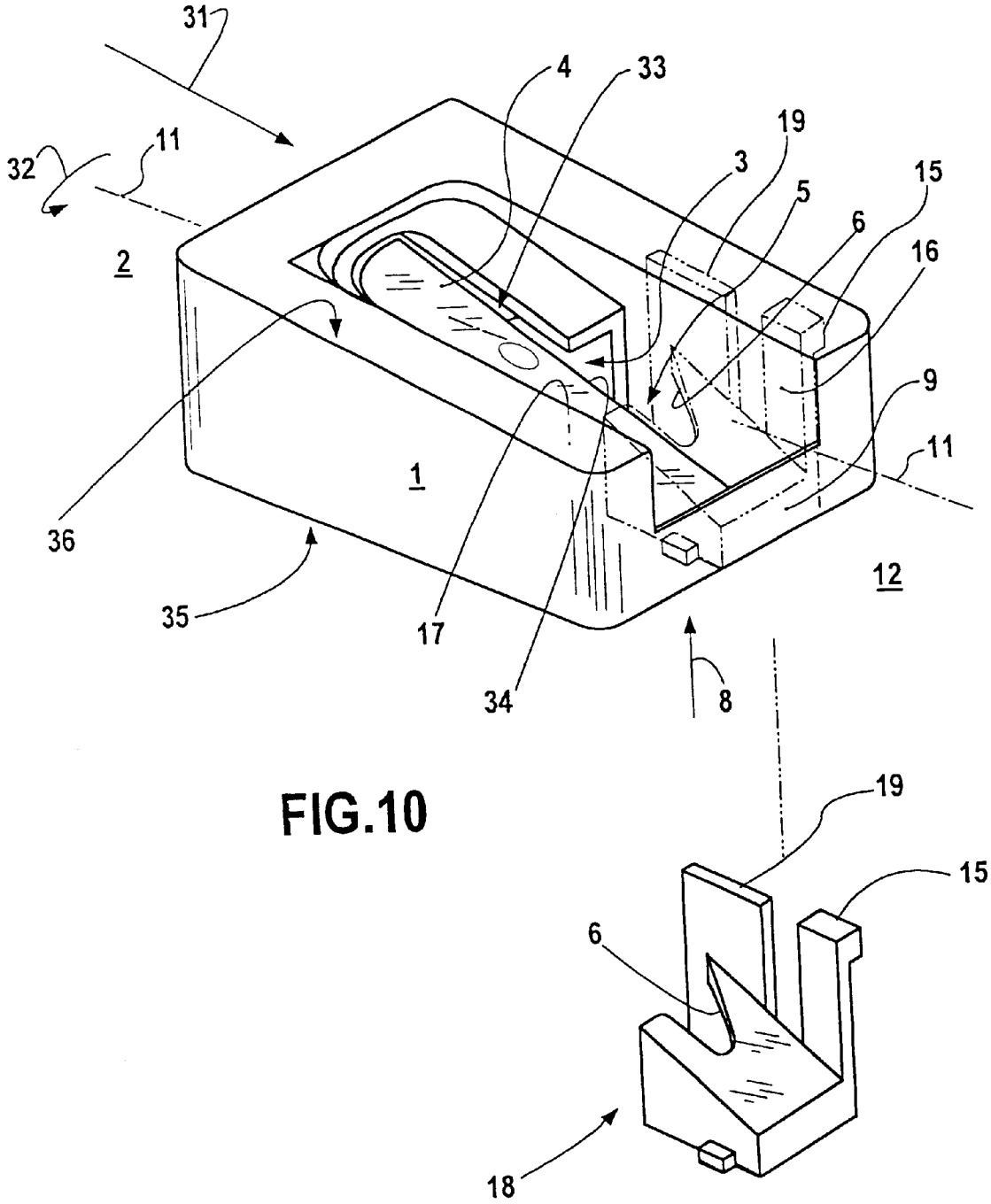
FIG. 10 is a plan view in perspective of a second embodiment of the sharpener, and the insert used therein, similarly to FIG. 1.
Figure 11:
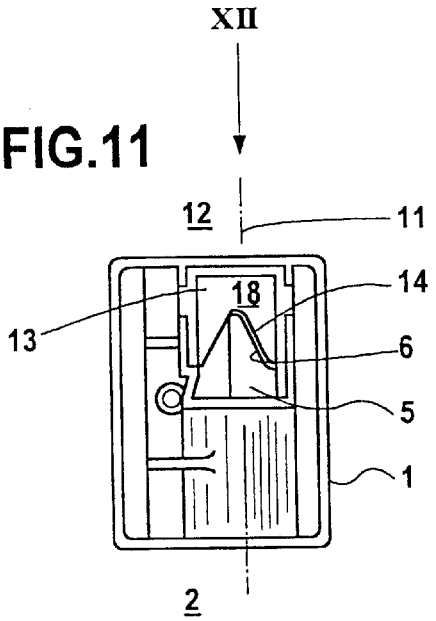
FIGS. 11 through 15 are representations analogous to FIGS. 2 through 6 of the sharpener according to FIG. 10, from various sides of the sharpener in the viewing directions indicated by Roman numerals.
Figure 12:
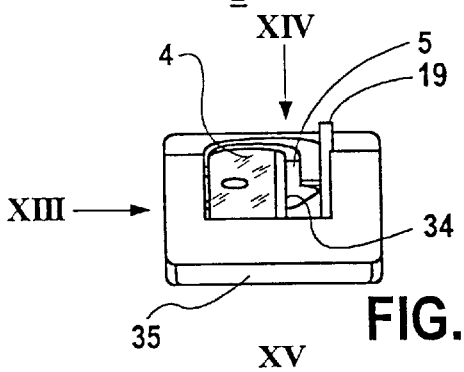
Figure 13:
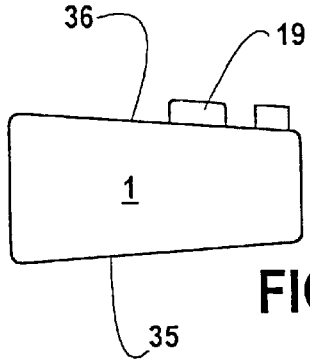
Figure 14:
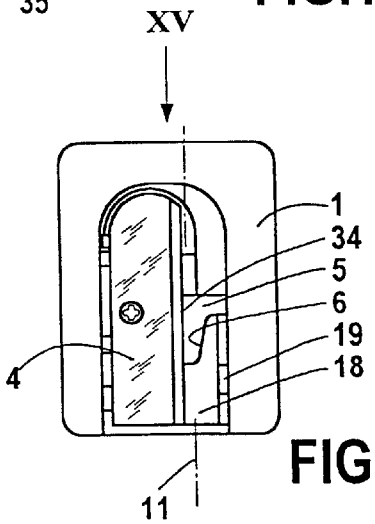
Figure 15:
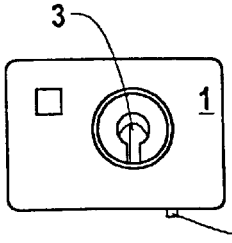
Figure 16:
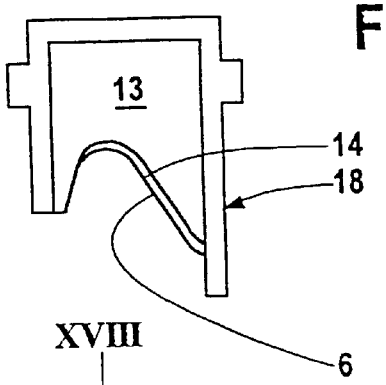
FIG. 16 is a view from below of an insert as a core shaper, the inserted position in the sharpener being shown in FIG. 11.
Figure 17:
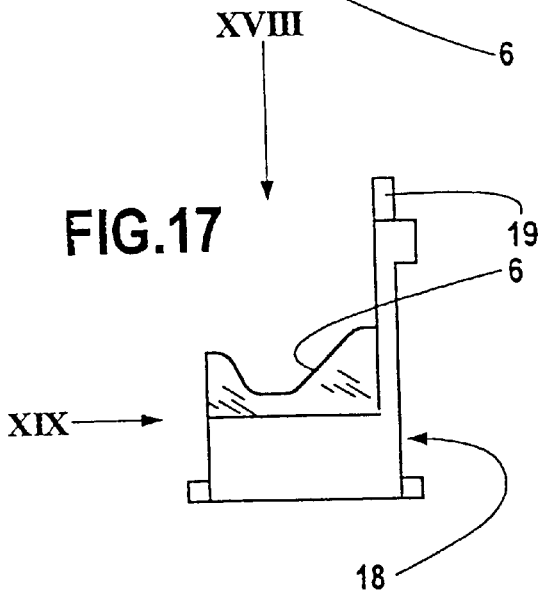
FIG. 17 is a side view of the insert corresponding to the arrow direction XVII in FIG. 16.
Figure 19:
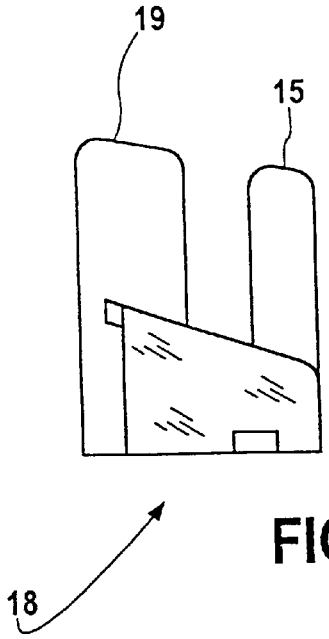
FIG. 19 is a side view in the direction of arrow XIX of FIG. 17.
Figure 18:
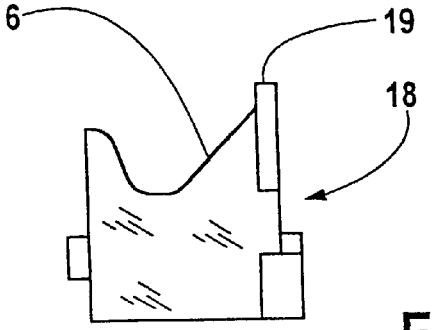
FIG. 18 is a plan view of the insert in the viewing direction XVIII of FIG. 17.

The guide channel 3 tapers in the direction of a free space 5 of the housing 1, which receives the pencil cone and is positioned beneath the front end of the sharpening blade 4. In the case of the housing 1 illustrated in FIG. 1, this free space 5 is open on the rear side of the housing facing away from the guide channel 3, in the direction of the longitudinal axis 11 of the guide channel 3. In the case of the embodiment according to FIG. 10, the free space is closed by a rear housing wall 9. During sharpening, the pencil, not shown, is rotated against the cutting edge 34 of the sharpening blade 4 in the sharpening direction (direction of rotation) 32 inside the guide channel 3. The cutting edge 34 of the sharpening blade 4 removes a strip of the outer material from the tip of the soft-core pencil.

A shaping edge 6 of an insert 7 provided as a core shaper projects into the free space 5 for shaping the core tip. In the case of the embodiment according to FIG. 1, the insert 7 closes the free space 5 at its end on the rear side, which faces away form the guide channel 3. It effectively represents the closure of the guide channel 3 at the rear housing side 12, and, at its front end facing the guide channel 3, it supports the shaping edge 6 for peeling off material to shape the core. The core of the soft-core pencil being rotated in the sharpening direction 32 presses the shaping edge 6 upward from below, so the strips of removed material fall down. While the cutting edge of the sharpening blade 4 acts upward (FIGS. 1, 10) with respect to the strips of removed material, the shaping edge 6 of the insert 7 acts downward with respect to FIGS. 1 and 10.

In the sharpener embodiment according to FIGS. 1 through 6, the insert 7 is fixed in the free space 5, in front of the open front end of the guide channel 3, by means of frictional clamping or a snap connection. The insert is pushed onto the two side segments of the rear housing wall 9 from below, that is, from the housing underside 35 in the insertion direction 8. In FIG. 1, the insert 7 includes a push-on groove 10 that extends around the side segments of the rear housing wall 9.

When the insert 7 is pushed on or inserted from below, that is, into the free space 5 from the housing underside 35 in the insertion direction 8, the sharpening blade 4 serves as an end stop. The insert 7 extends over the entire width of the free space 5, and can therefore also be spread in the free space 5. The underside 13 of the insert 7, whose shaping edge 6 supports the downward-projecting scraping rib 14, forms a bowl-like or tray-like surface for catching the soft-core shavings.

To facilitate the removal of the insert 7 from the free space 5, the insert includes a handling projection 15, which extends upward or to the rear beyond the contour of the housing 1. The handling projection 15 is positioned on a side of the insert 7 that faces away from the sharpening blade 4, and, in the embodiment according to FIGS. 1 through 9, beyond the housing body 1 toward the rear housing side 12. The insert 7 can also be clamped between the side flanks 16, 17 of the free space 5 or tensed between positioning elements attached to the side flanks.

The rear housing wall 9 closes the free space 5 at the rear in the embodiment of the sharpener according to FIGS. 10 through 19. Here, a different insert 18 is used. It is also secured in the free space 5 by means of a frictional clamping. An expansion connection is used here, with which the insert 18 is spread between the flanks 16, 17 of the free space 5. It is also inserted into the free space 5 from below in the insertion direction 8. The sharpening blade 4 again forms an end stop for the insertion movement of the insert 18.

The insert 18 also has a handling projection 19, which, however, extends upward beyond the housing body 1.

Figure 20:
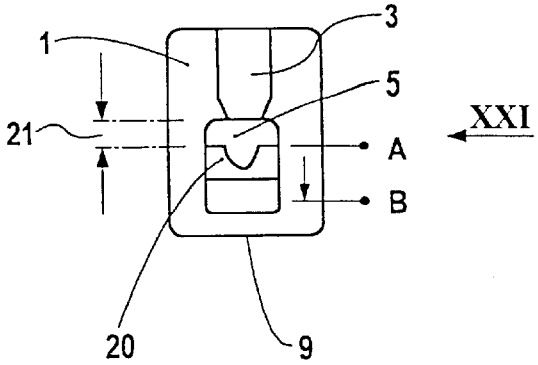
FIG. 20 is a schematic plan view of a further embodiment of a sharpener, with an insert being inserted as a core shaper into the free space.
Figure 20:
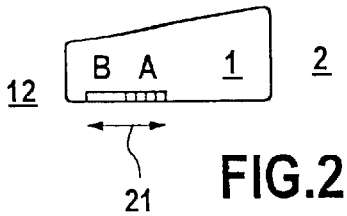
Figure 21:
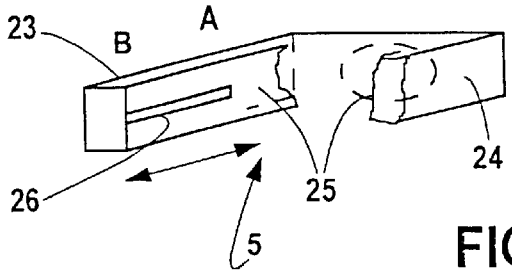
FIG. 21 is a side view in the arrow direction XXI of FIG. 20.

The insert 20 in the embodiment according to FIGS. 20 through 23 differs in many ways from the inserts 7 and 18 described in conjunction with FIGS. 1 through 19. First, it can be positioned or secured at different distances 21 from the end of the guide channel 3. FIG. 20, for example, shows the possible selectable position settings A and B.

Figure 22:
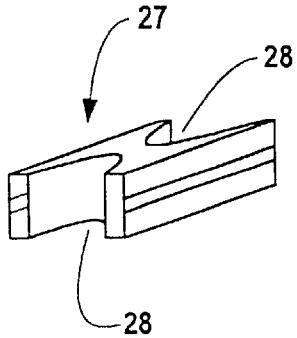
FIG. 22 is a schematic, simplified, perspective view of the free space in the housing body 1, with a longitudinally-displaceable core shaper shown on the right.
Figure 22:
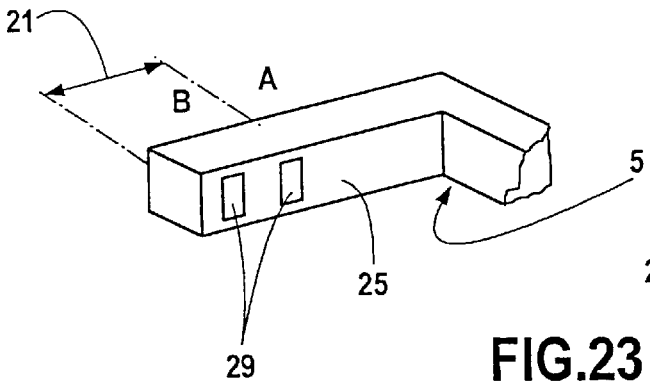

FIG. 22 is a schematic view in perspective of the free space 5 as a U, with two U legs 23 and 24. Infinitely-variable longitudinal guides 26 for inserts 27 are provided at the inside flanks 25 of the side walls of the free space 5 shown as U legs 23, 24; at their two ends, the guides have a shaping edge 28 for core shaping, which can be selectively converted in its operational position.

Figure 23:
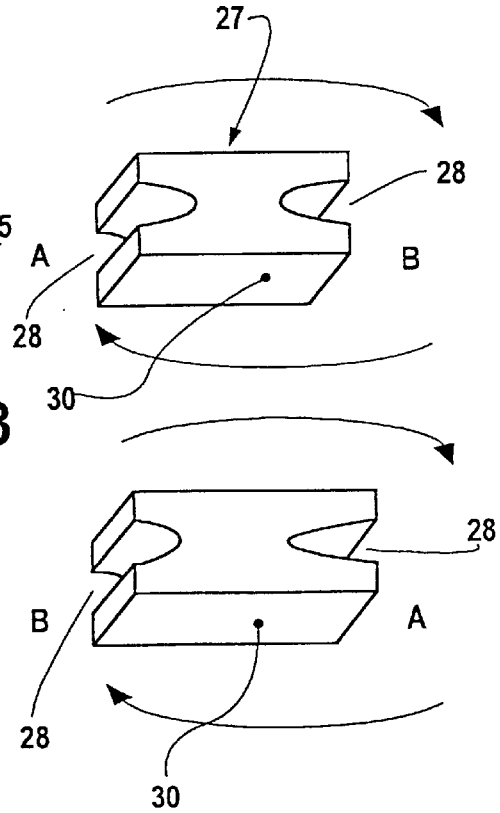
FIG. 23 illustrates a modified embodiment of the free space 5 according to FIG. 22, with an insertable insert that acts as a core shaper shown in its two different inserted positions on the right.

In FIG. 23, it is possible to provide a snap connection between the two form-fitting parts 29, 30 in the different secured positions A and B in place of a longitudinal guide 26 for the insert 27.

To identify the shape of the shaping edges of various inserts, for example, inserts 7, 18, 20, 27 equipped with different shaping edges 6, color-coding of the inserts can be used to distinguish the inserts with respect to the shape of their edges.

It will be understood that the above description of the present invention is susceptible to various modifications, changes and adaptations, and the same are intended to be comprehended within the meaning and range of equivalents of the appended claims.

What is claimed is:

1. A sharpener for sharpening an end of a pencil having a soft core, the sharpener comprising:

a housing body defining a free space and a conical guide channel for receiving and centering the pencil end, the guide channel being tapered towards a front end thereof, and having a side opening; said housing body having a rear side;

a sharpening blade dispensed along said side opening for sharpening the pencil end into a conical shape; and an exchangeable insert secured in the free space of said housing body in front of the front end of the guide channel, said insert having a shaping edge for shaping the pencil core, and said shaping edge facing the guide channel and being spaced from said sharpening blade; said insert forming a limiting wall that closes the free space at the housing body rear side.

2. A sharpener for sharpening an end of a pencil having a soft core, the sharpener comprising:

a housing body defining a free space and a conical guide channel for receiving and centering the pencil end, the guide channel being tapered towards a front end thereof, and having a side opening; said housing body having a housing body underside;

a sharpening blade dispensed along said side opening for sharpening the pencil end into a conical shape; said free space being open toward the housing body underside in a direction facing away from the sharpening blade; and an exchangeable insert secured in the free space of said housing body in front of the front end of the guide channel, said insert having a shaping edge for shaping the pencil core, and said shaping edge facing the guide channel and being spaced from said sharpening blade; said insert being inserted into the free space from the housing body underside.

3. A sharpener for sharpening an end of a pencil having a soft core, the sharpener comprising:

a housing body defining a free space and a conical guide channel for receiving and centering the pencil end, the guide channel being tapered towards a front end thereof, and having a side opening;

a sharpening blade dispensed along said side opening for sharpening the pencil end into a conical shape;

an exchangeable insert secured in the free space of said housing body in front of the front end of the guide channel, said insert having a shaping edge for shaping the pencil core, and said shaping edge facing the guide channel and being spaced from said sharpening blade; said insert being adjustable in an axial direction of the guide channel inside the free space of the housing body; and means for securing said insert at different axial distances from the guide channel.

4. A sharpener for sharpening an end of a pencil having a soft core, the sharpener comprising:

a housing body defining a free space and a conical guide channel for receiving and centering the pencil end, the guide channel being tapered towards a front end thereof, and having a side opening;

a sharpening blade dispensed along said side opening for sharpening the pencil end into a conical shape; and an exchangeable insert secured in the free space of said housing body in front of the front end of the guide channel, said insert having a shaping edge for shaping the pencil core, and said shaping edge facing the guide channel and being spaced from said sharpening blade; said insert being adjustable at infinitely-variable different axial distances inside the free space of said housing body.

5. A sharpener for sharpening an end of a pencil having a soft core, the sharpener comprising:

a housing body defining a free space and a conical guide channel for receiving and centering the pencil end, the guide channel being tapered towards a front end thereof, and having a side opening;

a sharpening blade dispensed along said side opening for sharpening the pencil end into a conical shape;

an exchangeable insert secured in the free space of said housing body in front of the front end of the guide channel, said insert having a shaping edge for shaping the pencil core, and said shaping edge facing the guide channel and being spaced from said sharpening blade; wherein said insert extends over an entire width of the free space; and a scraping rib supporting said shaping edge of said insert; said scraping rib having a scraping rib underside facing away from the sharpening blade that forms a tray-like surface for catching the shavings of the soft pencil core.

6. A sharpener for sharpening an end of a pencil having a soft core, the sharpener comprising:

a housing body defining a free space and a conical guide channel for receiving and centering the pencil end, the guide channel being tapered towards a front end thereof, and having a side opening; said housing body having a top side;

a sharpening blade dispensed along said side opening for sharpening the pencil end into a conical shape; and an exchangeable insert secured in the free space of said housing body in front of the front end of the guide channel, said insert having a shaping edge for shaping the pencil core, and said shaping edge facing the guide channel and being spaced from said sharpening blade; said insert having a handling projection extending beyond the housing body top side for facilitating removal of said insert from the free space; said handling projection being positioned on a side of said insert that faces away from said sharpening blade and projecting upward beyond said housing body.

7. A sharpener for sharpening an end of a pencil having a soft core, the sharpener comprising:

a housing body defining a free space and a conical guide channel for receiving and centering the pencil end, the guide channel being tapered towards a front end thereof, and having a side opening;

a sharpening blade dispensed along said side opening for sharpening the pencil end into a conical shape;

an exchangeable insert secured in the free space of said housing body in front of the front end of the guide channel, said insert having a shaping edge for shaping the pencil core, and said shaping edge facing the guide channel and being spaced from said sharpening blade; said insert having a jacket comprising at least a pair of diametrically-opposite shaping edges having different shaping contours; and means for converting an orientation of said shaping edges in the free space so that said shaping edges are selectively brought into an operational position.

8. A sharpener for sharpening an end of a pencil having a soft core, the sharpener comprising:

a housing body defining a free space and a conical guide channel for receiving and centering the pencil end, the guide channel being tapered towards a front end thereof, and having a side opening;

a sharpening blade dispensed along said side opening for sharpening the pencil end into a conical shape; and an exchangeable insert secured in the free space of said housing body in front of the front end of the guide channel, said insert having a shaping edge for shaping the pencil core, and said shaping edge facing the guide channel and being spaced from said sharpening blade; there being provided a plurality of inserts having different shaping edges, said inserts being color-coded for distinction from each other.

9. The sharpener according to claim 1, wherein said insert is secured by a snap connection.

10. The sharpener according to claim 1, wherein said insert is secured by frictional clamping.

11. The sharpener according to claim 2, wherein said sharpening blade forms an end stop for stopping the insertion of said insert.

12. The sharpener according to claim 1, wherein said housing body has side flanks defining sides of the free space and said insert is clamped between said side flanks.

13. The sharpener according to claim 1, wherein said housing body has side flanks defining sides of the free space and said insert is tensed between positioning elements attached to said side flanks.

14. The sharpener according to claim 1, further comprising a housing wall closing said housing body at an outer end of the free space.

* * * * *